United States Patent [19]

Kavalir et al.

[11] 4,002,983

[45] Jan. 11, 1977

[54] VEHICLE-EMERGENCY CALL SYSTEM

[75] Inventors: Jaroslav Kavalir; Miroslav Studnicka, both of Prague, Czechoslovakia

[73] Assignee: Tesla, narodni podnik, Prague, Czechoslovakia

[22] Filed: Feb. 28, 1974

[21] Appl. No.: 446,590

[52] U.S. Cl. ..... 325/54; 325/64; 340/32

[51] Int. Cl.[2] ..... H08G 1/00

[58] Field of Search ..... 325/1, 51, 53, 54, 64, 325/117; 340/22, 31 R, 32, 33

[56] References Cited

UNITED STATES PATENTS

| | | | |
|---|---|---|---|
| 3,281,789 | 10/1966 | Willcox et al. | 325/55 X |
| 3,441,858 | 4/1969 | Graham | 340/33 X |
| 3,461,423 | 8/1969 | Trumble | 325/117 X |
| 3,492,581 | 1/1970 | Wisniewski | 340/32 X |
| 3,721,955 | 3/1973 | Schiff et al. | 340/32 |
| 3,743,937 | 7/1973 | Saillard | 325/51 X |

*Primary Examiner*—Benedict V. Safourek

[57] ABSTRACT

An emergency call system for vehicles using the public highways is described. The system includes a radio transmitter located in each of one or more vehicles. This vehicle transmitter is provided with an output of predetermined information which is selectively operable by the vehicle operator or the passengers. Spaced at predetermined distances along the highway are a plurality of road receivers each having an input tuned to the output frequency of the vehicle transmitter and a coded-signal generator. The coded-signal generator has an output indicative of the road receiver and of the information output of the vehicle transmitter as it is received by the road receiver. This coded-signal is transmitted to a registering means remote from the receiver which decodes and displays the coded signal. As a result of which assistance and/or rescue can be promptly dispatched to the vehicle as a result of the known location of the road receiver.

11 Claims, 4 Drawing Figures

VEHICLE-EMERGENCY CALL SYSTEM

BACKGROUND OF THE INVENTION

The present invention relates to a wireless or radio emergency call system and in particular, to a system for automatically and instantaneously providing an indication of a vehicle accident and/or vehicle need.

The constant increase in the use of motor cars and road vehicles has inevitably resulted in intensified traffic on the public highways. The number of emergency situations and motor car accidents reaches higher and higher levels each year and in many cases urgent medical assistance and transport of injured people to a hospital is required. In general in densely urbanized communities well organized emergency telecommunications services are available. However, on major intercity highways, particularly in very sparsely settled and remote areas, communications are not available so that a great deal of time elapses between the occurrence of an accident and the dispatch of rescue or aid thereto. Consequently, many people still have to die just because medical help is not readily available. In these remote areas the identification of the exact place of the accident and the nature of the accident or the situation in which the motor vehicle is found can not be easily determined except by chance and only after the arrival of the first of the rescue units.

It is an object of the present invention to provide an emergency call system which removes the above mentioned disadvantages and which provides an automatic and instantaneous communication system.

It is an object of the present invention to provide a radio emergency call system in which both the nature of the assistance required and the place at which the assistance is required is instantly indicated simultaneously with the call for assistance.

The objects and advantages of the present invention will be clearly apparent from the following disclosure of its principal forms.

SUMMARY OF THE INVENTION

According to the present invention the emergency call system comprises the location of a radio transmitter of similar construction and function in each of one or more vehicles. Each of the vehicle transmitters has means for providing an output of predetermined information relating to the nature of assistance required should an accident or breakdown occur. Simultaneously there is spaced at predetermined intervals along each highway or road a plurality of road radio receivers. The road receivers each have an input tuned to the output frequency of the vehicle transmitters and means for decoding the input information received by it. A coded-signal generator is connected to each of the road receivers and provides an output indicative of the position of a given road receiver and of the situation information output of the vehicle transmitter. This output is transmitted to a remote receiver and registering means which decodes and translates the coded signal providing auditory visual and recorded information from which the proper help, assistance and service can be dispatched to the vehicle.

In one form of the present invention each of the road receivers have their output connected in parallel to a common cable so that the coded signal is transmitted telegraphically to the registering means. In another form of the invention the output of the road receiver can be in the form of a radio or wireless signal transmitted via air to the registering means. In the latter instance the radio transmitter for the road receiver may each have different channels of frequency spectrum or be provided with only one time shared channel.

It is preferred that the vehicle radio transmitter be simple in construction and be provided with several push button means each of which when activated causes the radio transmitter to create a particularly distinctive signal indicative of the nature of the accident, or service required. Preferably the source of power for the vehicle transmitter is derived from the battery of the vehicle through at least one of the push button means so that normally the vehicle transmitter is inoperative unless actuated via the push-button. In addition, it is preferable that the push button be provided with means for preventing the abuse of the transmitter, that is, for preventing its premature use or excessive use. Such means may comprise a latching relay or circuit which after each use must be specifically reset by a special operator or with the use of special means.

Each of the road receivers have a supply source and are provided with means for integrating the input signal from the vehicle transmitter with a particular coded denomination indicative of its position along the road, i.e. milestone or distance from a given remote registering means, so that its coded output signal not only advises the registering means of the fact that an emergency exists but also advises it of the nature of the emergency and the exact location of the emergency. Preferably the road receiver is also provided with a time delay circuit which enables the output signal to be delayed with respect to the output signals of adjacent road receivers so that the road receiver nearest the emergency will be the first to transmit. This will also prevent interference should multiple emergency signals be received by one or more road receivers.

It will be obvious that it will be preferred to provide the system with numerous registering means located at convenient intersections of the highways or at selected points as for example, police and highway patrol booths, service stations and the like so that help and assistance can be obtained from one or more locations each being within a more or less limited operative range.

Full details of the present invention are given in the following description of its preferred embodiments, and are depicted in the accompanying drawings, to which reference must be made.

DESCRIPTION OF THE INVENTION

Figure 1:
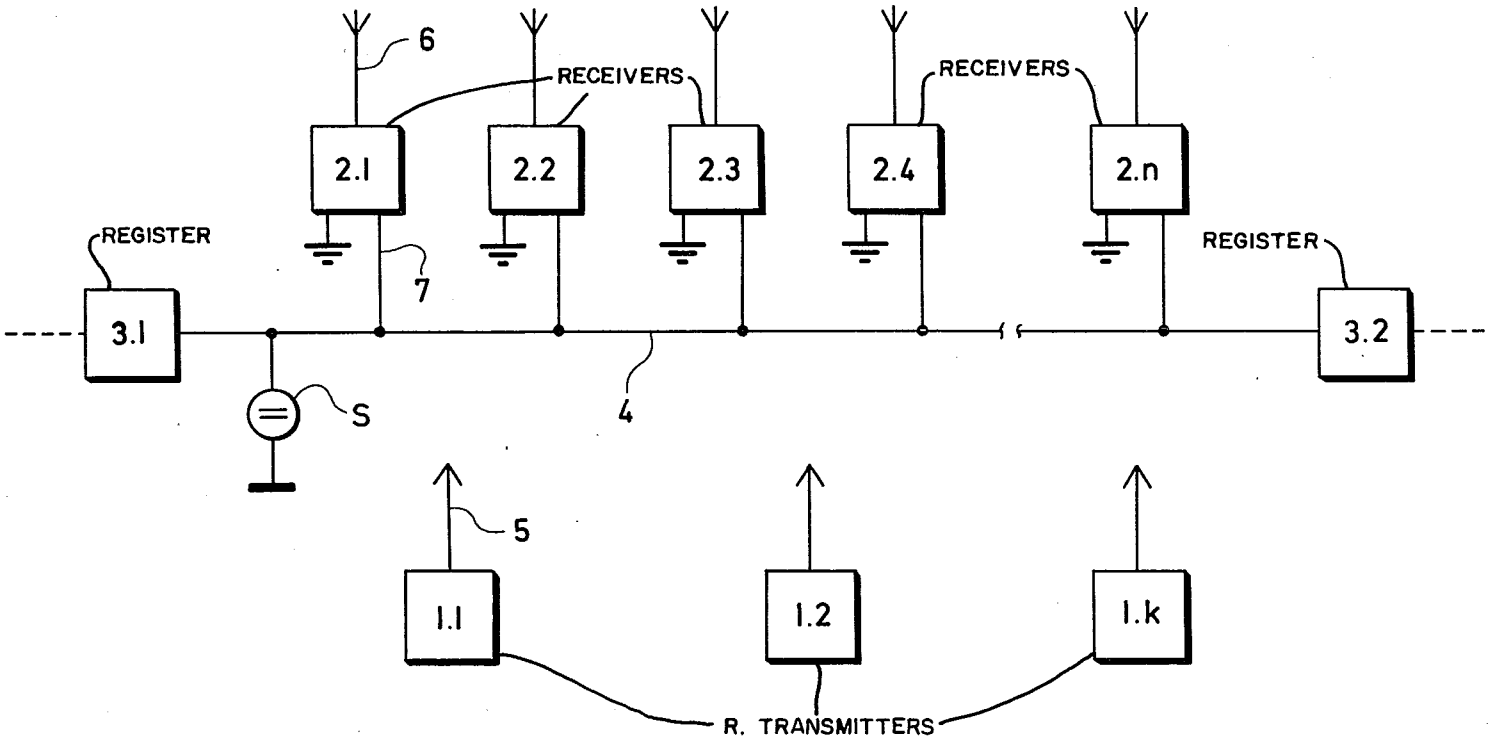
FIG. 1 is a schematic diagram of the wireless emergency call system, using a communicating cable between the respective road receivers and the central control and dispatching stations at which the registering means are located.

To illustrate the present invention it should be assumed that FIG. 1 shows the existence of a road or highway of indefinite length along which a series of vehicles 1.1 through 1.*k* are travelling. Each vehicle is provided with a radio transmitter (more specifically seen in FIG. 2) capable of emitting on demand a coded signal indicative of a specific need or situation in which the vehicle is found. Spaced at given intervals along the road are radio collectors and receivers 2.1 through 2.*n* (seen in FIG. 3) connected in parallel by a common cable or communication line 4 to spaced registering and recording devices 3 (FIG. 4) which are located at a central control and dispatching station from which assistance or rescue can be dispatched to the vehicle.

Figure 2:
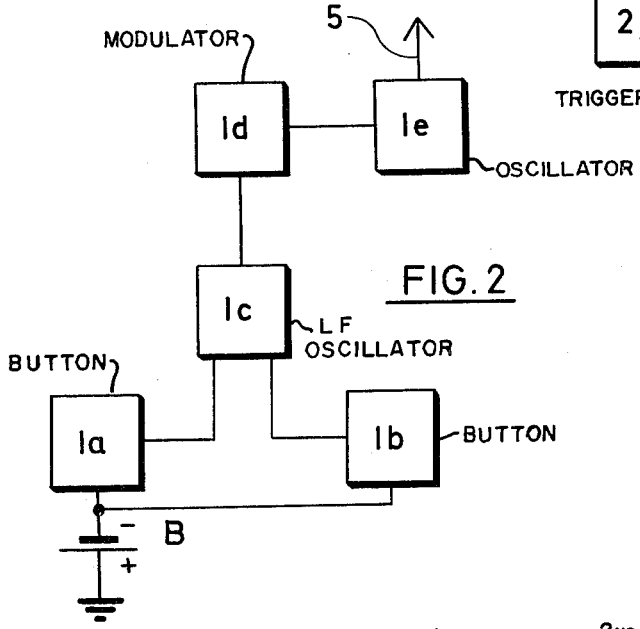
FIG. 2 is a schematic diagram of the circuit arrangement of a vehicle transmitter.

Each vehicle transmitter, as seen in FIG. 2, comprises a crystal controlled oscillator 1*e* the output of which is connected to an aerial 5. The oscillator 1*e* is modulated by means of a modulation circuit 1*d* receiving an input from a low frequency oscillator 1*c*. The low frequency oscillator 1*c* is operated by a plurality of push buttons 1*a*, 1*b*, etc., corresponding to the specific need or situation in which the vehicle is found. The push buttons 1*a* and 1*b* etc. may provide individually or severally connection of the vehicle transmitter to the motor car battery B. The push buttons are provided with suitable mechanical spring means or the like which limit their time of operation or if desired with suitable relay circuitry which provide a given limited pulse or signal. In this manner the operation time of the transmitter may be made sufficiently long to provide an effective output signal but may also be maintained sufficiently short enough to render the network or system free for subsequent use by other vehicles, as soon as possible. In addition to the limitation of the transmitting time, the push button arrangement is provided with means for preventing the abuse of the transmitter by unauthorized personnel and/or by successive actuation. Suitable latching circuitry, and/or mechanical latching means is provided so that the radio transmitter must be manually reset after each use. Preferably the latching or mechanical resetting devices are so arranged that this can only be done by an authorized service person, police official or the like.

Figure 3:
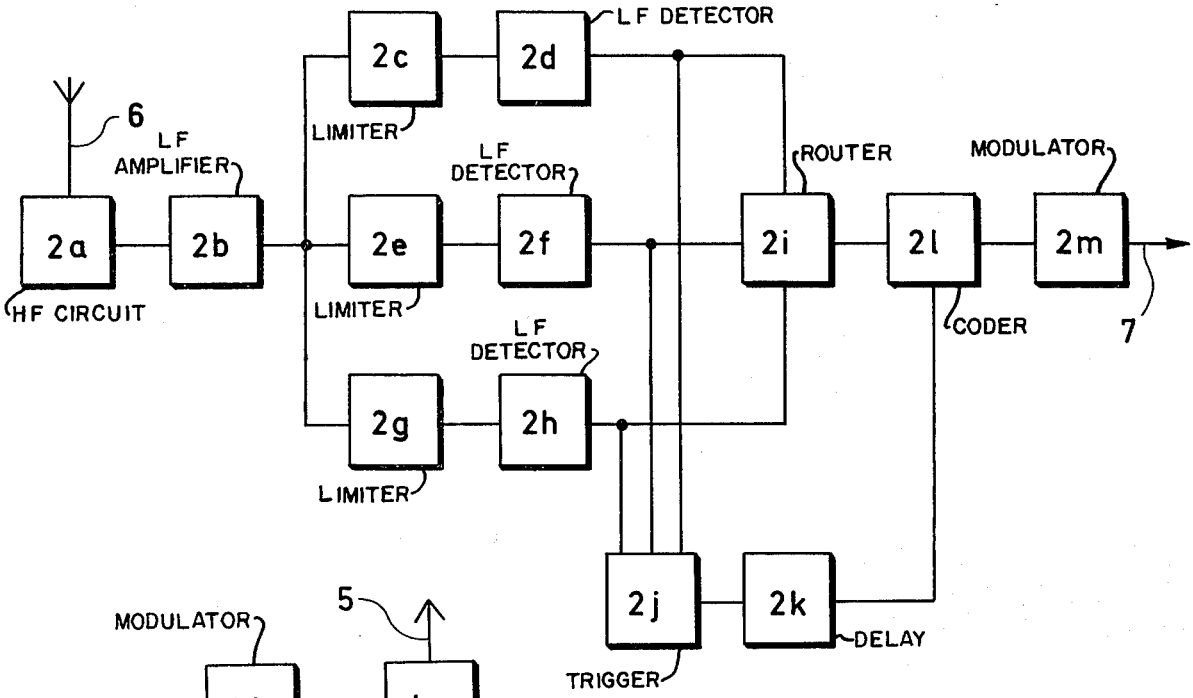
FIG. 3 is a schematic circuit diagram of an individual road collecting receiver and its coded signal transmitter means.

Each of the road collecting receivers 2 are identical and are tuned to the output frequency of the vehicle radio transmitters. The receivers 2 are spaced at uniform distances or at given intervals along the highway. As seen in FIG. 2 the receivers 2 comprise an all-directional whip type antenna 6 which receives the output signal transmitted from the vehicle transmitter. The transmitted signal of course indicates the need for assistance by the vehicle and as a result of the particular push button depressed the type of assistance needed. The received signal is detected and amplified in a high frequency circuit 2*a*, as seen in FIG. 3, from which it is passed to a low frequency amplifier 2*b*, the output of which is connected in parallel to a first set of group-limiters 2*c*, 2*e* and 2*g* which are in turn connected to a second set of group-low frequency detectors 2*d*, 2*f* and 2*h* respectively. From the detectors 2*d*, 2*f* and 2*h* the signal proceeds, on the one hand to a second signal generating routing circuit 2*i* and on the other hand simultaneously to a trigger circuit 2*j*. In the routing circuit 2*i* the vehicle transmitted input signal is by a preset, precoded and recorded information signal indicative of the data corresponding to the position of the particular receiver 2 so that a combined output signal is obtained of the input information derived from the vehicle transmitter and the receiver. This integrated information is fed to a code generator 21 which is subsequently triggered by the trigger circuit 2*j*. The coded signal from the signal generator 21 provides a single signal which indicates both the position of the collecting receiver and the emergency condition of the vehicle. This latter signal passes to a signal modulator 2*m*, the output of which leads via a line 7 directly to the common communication cable 4 and thus to each of the adjacent control station registering devices 3.1 and 3.2, as will be apparent from FIG. 1. Interposed between the trigger circuit 2*j* and the code generator 21 is a time delay circuit 2*k*, the purpose of which is to delay in timed sequence the output coded signal of the coded generator 21 and the modulator 2*m* with respect to the neighboring or adjacent receivers 2 thus facilitating identification of the calling signal from the receivers in the control station registering devices 3, should the vehicle transmission output signal be received by one or more road receivers 2. The signal code generator 21 and its connected modulator 2*m* form a transmitting unit of its own, as an integral part of the road receiver. Consequently the receiver 2 may be considered as both a receiver and a coded signal transmitter.

In the embodiment shown in FIG. 1 the modulated signal output from the coded signal transmitter (2*l*–2*m*) is transmitted in telegraphic or telephonic fashion over the common cable 4. The cable 4 may be a coaxial type capable of carrying signal messages in several forms. The cable 4 may also serve as the common conduit for the power source S which may be common line current or battery current. The receivers 2.1 through 2.*n* are thus preferably connected in parallel with the cable 4 so as to be powered and operable independently of each other. It will be also apparent that the coded signal and modulator 21 and 2*m*, respectively, may be constituted as a radio or wireless transmitter of its own in which case the line 7 will lead from the modulator 2*m* directly to a suitable antenna wherein the signal may be transmitted over the air waves to the respective registering devices 3.1 and 3.2. In this case, it may be preferable to provide each of the receiver and signal code transmitter units with different channels within the frequency spectrum or with only one time shared channel, the time sharing maintaining differentiation between the individual coded signal transmitters and their associated receivers.

Figure 4:
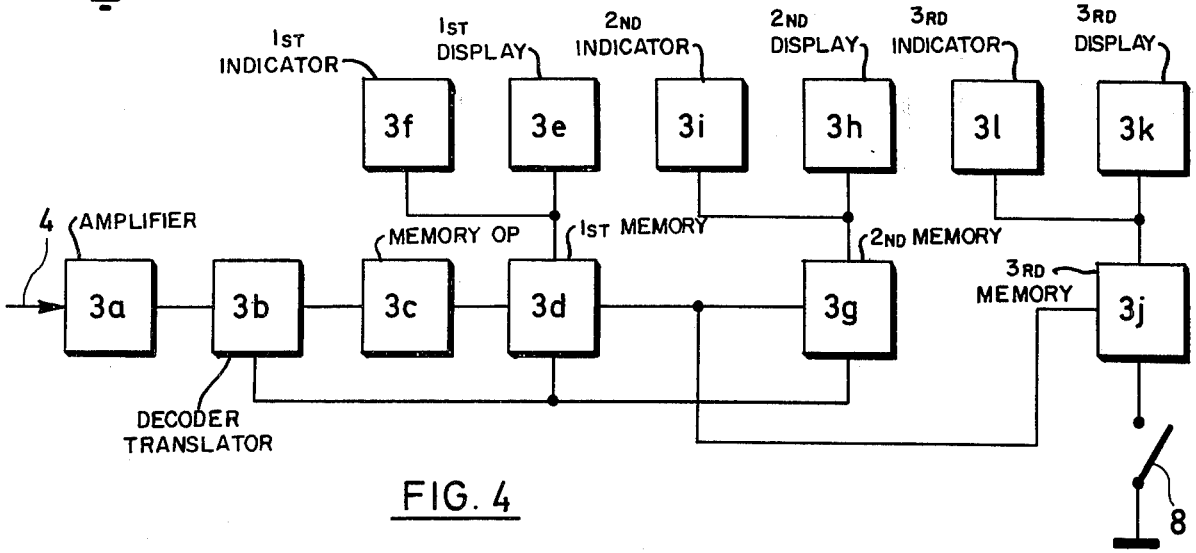
FIG. 4 is a schematic circuit diagram of the registering and recording device including the code translator, as located at the central dispatching station.

The coded signal transmitted from the respective receivers 2 is received at the control dispatch station in the registering device 3, seen in detail in FIG. 4. The device comprises an amplifier 3*a* the output of which is connected to a decoder or translator 3*b* which evaluates the several bits of information carried by the coded signal. The evaluated bits of information are then stored in an operating memory unit 3*c* from which a signal is supplied to a first operating memory 3*d*. The operating member 3*d* provides an output to a first display unit 3*e* and a first service indicator 3*f* at which an optical auditory or recorded signal appears corresponding to the demand expressed by the actuation of the selected ones of the push buttons 1*a*, 1*b*, etc., initially actuating the vehicle transmitter (FIG. 2). From the output of the first operation memory 3*d* the information proceeds further to a second information memory 3*g* which is also provided with a display unit 3*h* and a second service indicator 3*i*. In the first operating memory 3*d* the signal is converted to a two-place number which is displayed on the first display unit 3*e*. This indicates which of the receivers 2 the signal has originated from. If another emergency call arrives in the registering device 3, the information is automatically switched over either directly from the decoder 3*b* or from the first operating memory 3*d* to the second operating memory 3*g* so as to appear on the second display 3*h*. A third operating memory 3*j* having a third display unit 3*k* and a third service indicator 3*l* serves for manual or hand written recording of the information from the first operating memory 3*d*, and its display unit 3*e*, in the event of a rapid sequence of additional emergency calls. The circuit is completed by an on-off switch 8 available to the operator at the control and dispatching station.

Operatively, in the case of an accident or for some other emergent reason, one of the passengers the driver, or a passerby, pushes one of the push buttons of the vehicle radio transmitter 1.1 through 1.*k*, (FIG. 1), causing the transmission from the vehicle of a coded signal indicating the nature of the distress, accident or situation in which the vehicle is found. This produces a coded signal over a given period of time which is transmitted to the nearest road receivers spaced along the highway. Preferably three push buttons are provided in the vehicle transmitter, the first push button intended for calling medical rescue services, the second for calling for normal road service such as towing, tire repair, or for emergency gasoline or petrol, and the third push button for calling the highway or local police. It may be desirable to provide the vehicle transmitter with means allowing for the operation of two or more of the push buttons simultaneously so that for example both medical service and highway police can be called simultaneously. Along most highways and roads it is quite simple to disperse the receivers 2 at nearly uniform distances between them as for example one or two kilometers apart while the respective control and dispatching stations may be located at an even greater distance from each other.

On receiving a signal from the vehicle transmitter 1 the collecting and receiver 2 is actuated so as to produce a coded signal integrating the calling signal received from the vehicle as well as the fixed signal indicating the position of the receiver 2. This coded signal is then transmitted either via the cable 4 or the radio mechanism to the registering device 3 located in the adjacent control and dispatching stations. The registering device processes the signal in order to distinguish the sort of information transmitted, decoding at the same time the distinguishing number belonging to the receiver which is transmitting the coded signal. Thus full and complete information is given, namely which kind of assistance is required and from what position along the highway the assistance is requested. The controller/operator of the control and dispatching station is able to store the information in the memory bank of the registering means or manually record the information. In this manner the system is free for the reception of a new emergency call within a very short time. The controller/operator of the control and dispatching station is then free to organize and command the necessary help for dealing with the road situation, in the usual and conventional manner by dispatching either the police, medical or service personnel. The means for rendering the push buttons selectively operable only once and thus preventing the abuse of the vehicle transmitter also prevents the receipt of repetitive and redundant emergency calls in the dispatching station so that the controller/operator is free of conflicting calls.

From the foregoing it will be seen that the substantial features of the present invention consist in a wireless communication between the vehicles moving or parked along the road. This communication is instantaneous and carries with it informational bits indicative of the type of service required, the nature of the emergency as well as the specific location at which the vehicle is. Should the output signal from the vehicle be received by more than one receiver 2, the controller/operator at the dispatching station will be able to extrapolate and determine with respect to the two receivers exactly where the vehicle is. In any event the coded information received from the vehicle transmitter is received by one or more of the receivers which are connected by either wire or wireless radio telemetry to the dispatching stations. The system enables the immediate calling of any of the services mentioned. The assistance may be demanded by anyone in the vehicle or in the case of an accident by a passerby in the vicinity of the accident. Furthermore the request for information may be made by a separate and independent information passing the scene of the accident even though that vehicle is not involved in the accident or does not stop at the scene. The momentary signal activating the system establishes the given place and whether or not the vehicle moves the position of the initiating signal will remain the same.

With the system of the present invention the time needed for the arrival of assistance to cope with the emergency call is shortened to an absolute minimum. Thus, the rescue and preservation of life may be greatly increased while damage caused by the accident may be greatly minimized.

The emergency call system of the present invention is capable of universal use. It can be put into operation either within dense urban communities or outside such communities in a remote and sparse locations. The spacing of the receivers 2 can be made dependent on terrain and road conditions and since both the vehicle transmitter and the road receivers are tuned in frequency the movement of a vehicle from one community to another will present no difficulty since the systems will be compatible universally.

With regard to the arrangement of the system and the choice of the codes, the number of registered vehicles (i.e. vehicles participating in the system) may be practically without limitation.

Various modifications, changes and embodiments have been disclosed herein. Others, will be obvious to those skilled in the art. It is accordingly intended that the present disclosure be taken as illustrative of the present invention and not limiting of its scope in any manner.

What is claimed is:

1. An emergency call system for vehicles on public highways comprising a radio transmitter located in each of one or more vehicles, a plurality of fixed road receivers spaced at predetermined distance along the highway and at least one assistance dispatching station remotely located from said receivers, said vehicle transmitter having means for selectively providing a high frequency output of predetermined coded information indicative of one or more emergency conditions, said road receivers having an input tuned to the output frequency of the vehicle transmitter and a signal generator responsive to the receipt at said input of said predetermined coded information of said vehicle transmitter, said signal generator producing a coded output signal indicative of the given road receiver combined with the coded information indicative of the emergency condition received from said vehicle transmitter, and means for transmitting the combined coded signal, said dispatching station having means for receiving, and decoding said combined coded signal into independent indicia signifying the emergency condition and the given road receiver.

2. The system according to claim 1, wherein the means for providing an output of predetermined coded information in said vehicle transmitter comprises a plurality of push buttons each provided with means for producing a single, distinctive, short and time limited output coded signal giving said predetermined information.

3. The system according to claim 2 wherein said transmitter comprises a circuit including a modulator the output of which is connected to the input of the transmitter, the input of which is connected to the output of an oscillator which is actuated by at least one of said operating push buttons.

4. The system according to claim 2, wherein said road receiver includes a high-frequency circuit the output of which is connected to a low frequency amplifier, the output of said low frequency amplifier being connected in parallel to a plurality of limiters each being respectively connected to a low frequency detector, the output of said low frequency detectors being connected with the input of a signal generating circuit arranged to combine a precoded signal indicative of position of the road receiver with the received coded information, and with a trigger circuit, said trigger circuit being connected to the input of a generator for forming said combined precoded signal, said last mentioned generator being connected to the input of a modulator, the output of said modulator being transmitted to the input of said registering means.

5. The system according to claim 2 wherein said registering means includes an amplifier the output of which is connected to the input of a decoder which is interconnected with an operating memory, the output of said operating memory being connected to the input of a first display and to a first service indicator, a second working memory connected to the output of the operating memory and having a second display and second service indicator, a third working memory connected to the ouput of the operating memory and interconnected with the input of the second display and with the input of the second service indicator, the input of the third working memory being connected to the output of the first working memory, said third working memory having a third display and a third service indicator connected to the output thereof.

6. The system according to claim 1 wherein means for transmitting the coded signal from each of said road receivers is connected in parallel by a common communication line to the input of said registering means.

7. The system according to claim 6 including a source of power connected to said common communication line.

8. The system according to claim 1 wherein the means for transmitting the coded signal from each road receiver comprises a radio transmitter having a selective channel within the frequency spectrum.

9. The system according to claim 1 wherein the means for transmitting the coded signal from each road receiver comprises a radio transmitter having a time shared channel.

10. The system according to claim 1 wherein the registering means is provided with a memory for recording and processing signals received from the individual road receivers.

11. The method of providing emergency service for road vehicles comprising the steps of locating in each of the vehicles travelling on the road a transmitter capable of selective activation to provide and send out at high frequency a predetermined coded signal indicative of an emergency condition, locating a plurality of receivers at given intervals along the road, each of said receivers being tuned to the frequency of the vehicle transmitter and being operative at all times to receive said coded signal therefrom, combining the coded signal from the vehicle transmitter with a predetermined coded signal indicative of and produced by the road receiver in response to said received coded vehicle signal, and transmitting the combined coded signal to a remote dispatching station, translating and processing the coded signal received from the road receiver at said dispatching station to distinguish the predetermined coded signal of said vehicle and the predetermined coded signal of said road receiver and thereafter dispatching assistance to said vehicle in response to the information contained in the combined coded signal.

* * * * *